US006032384A

United States Patent [19]

Fingerson et al.

[11] Patent Number: 6,032,384

[45] Date of Patent: Mar. 7, 2000

[54] METHOD OF DRYING MOIST ORGANIC MATERIAL

[75] Inventors: Conrad F. Fingerson, Chatfield; Donald W. Eickhoff, Wykoff, both of Minn.

[73] Assignee: Heartland Forage, Inc., Wykoff, Minn.

[21] Appl. No.: 09/048,699

[22] Filed: Mar. 26, 1998

[51] Int. Cl.[7] ..... F26B 7/00

[52] U.S. Cl. ..... 34/427; 34/467; 34/495

[58] Field of Search ..... 34/395, 408, 413, 34/420, 427, 473, 495, 68, 86, 169, 174; 426/458, 451; 99/474, 477, 486; 131/296, 302, 303

[56] References Cited

U.S. PATENT DOCUMENTS

| | | | |
|---|---|---|---|
| 3,760,816 | 9/1973 | Wochnowski | 34/499 X |
| 3,829,986 | 8/1974 | Ruigrok et al. . | |
| 4,045,882 | 9/1977 | Buffington et al. . | |
| 4,050,164 | 9/1977 | Campbell . | |
| 4,101,264 | 7/1978 | Barr | 34/370 X |
| 4,189,848 | 2/1980 | Ko et al. | 34/473 |
| 4,251,925 | 2/1981 | Muhsil et al. . | |
| 4,253,825 | 3/1981 | Fasano . | |
| 4,268,971 | 5/1981 | Noyes et al. . | |
| 5,105,563 | 4/1992 | Fingerson et al. . | |
| 5,343,632 | 9/1994 | Dinh | 34/507 |
| 5,557,859 | 9/1996 | Baron . | |

OTHER PUBLICATIONS

Product Brochure, "Proctor Drying the World's Tobacco", Proctor & Schwartz, Bulletin 620/R (Apr. 1998).

Product Brochure, "Proctor Conveyor Dryers ° Ovens ° Heat Processing Equipment", Proctor & Schwartz, Bulletin 610/R (Oct. 1997).

Product Brochure, "FEC® Dryers and Coolers provide consistent quality and increase line yields", Food Engineering Corporation®, Undated.

*Primary Examiner*—Stephen Gravini

*Attorney, Agent, or Firm*—Merchant & Gould P.C.

[57] ABSTRACT

A method for drying a moist organic material which is continuously supplied in a stream includes passing hot air through the moist organic material in a part of the stream to absorb an amount of moisture, whereby the moist organic material cools the hot air into warm air. The warm air is reheated after it exits the moist organic material to form reheated air with increased capability of absorbing moisture, and the reheated air is passed through the moist organic material further upstream, which has a greater moisture content. The drying can preferably be performed in five minutes or less. A method for drying moist organic material using hot air includes providing the moist organic material in a continuous material stream, and providing the hot air in a continuous air stream. The air stream flows in a direction generally opposite to that of the material stream. The air stream is passed perpendicularly through the material stream at a plurality of zones, whereby the hot air absorbs an amount of moisture from the moist organic material in each zone. The air stream is reheated after it exits the material stream at one zone and before it enters the material stream at another zone further upstream.

23 Claims, 6 Drawing Sheets

METHOD OF DRYING MOIST ORGANIC MATERIAL

BACKGROUND OF THE INVENTION

The present invention relates to a method for drying moist organic material, in particular for drying forage crops.

Forage crops and other moist organic materials not harvested for silage are typically dried to obtain a desired moisture level to facilitate storage over extended periods of time. Drying usually occurs naturally outdoors in the field where it is cut and sometimes crimped to aid the drying process. There are several problems with this drying method; (1) natural drying relies on atmospheric temperatures (which are low compared to what can be achieved by artificial means), (2) the relative humidity of the air (which typically varies from a low of 50% to 100% in many areas of the world), (3) movement of the air which can typically vary from 30 mile an hour winds to no wind (and even during relatively high wind conditions the air does not necessarily move rapidly at ground level), and (4) some of the crop is necessarily close to or on the ground where drying occurs slowly because of the moisture coming from below. Though not typical, several methods have been tried to dry forage crops indoors. This always involves transporting a high volume type crop that has a high moisture content thus high mass. Typically two drying methods have been used. One dries by moving atmospheric air (sometimes heated) through the hay placed over open floors until dried. Another method moves the hay through a rotating drum via very hot air blowing through that drum. The latter has achieved energy efficiencies of 1600 to 1700 BTU per pound of water removed. Again, besides the high amount of energy used, the high moisture (thus high mass) forage products need to be hauled considerable distances to achieve a reasonable level of operation for a plant that requires a substantial capital investment.

If the drying process is intended to be used in a timely and efficient connection with harvesting of the organic material, it is imperative that the drying process can be carried out in synchronization with the harvesting. There have been attempts to dry forage crops in the field after cutting such as with the use of microwave heating or squeezing moisture out of the product but all have resulted in low throughput, high energy costs, high equipment cost or loss of product value.

The present invention solves these and other problems associated with existing apparatus and methods for drying moist organic materials.

SUMMARY OF THE INVENTION

The present invention generally relates to a method for drying moist organic material. With the present invention, the organic material is left on the field after cutting, and a drying machine working according to the method of the invention may later take up the material from the ground and dry it. This allows time for partial drying which happens rapidly during the early stages after cutting.

A method for drying a moist organic material which is continuously supplied in a stream includes passing hot air through the moist organic material in a part of the stream to absorb an amount of moisture, whereby the moist organic material cools the hot air into warm air. The warm air is reheated after it exits the moist organic material to form reheated air with increased capability of absorbing moisture, and the reheated air is passed through the moist organic material further upstream, which has a greater moisture content.

An embodiment of the method may be used in drying a mat of a forage crop, such as alfalfa, where the crop has a moisture content of preferably about 15–25% after drying. The drying can preferably be performed in five minutes or less.

A method for drying moist organic material using hot air includes providing the moist organic material in a continuous material stream, and providing the hot air in a continuous air stream. The air stream flows in a direction generally opposite to that of the material stream. The air stream is passed perpendicularly through the material stream at a plurality of zones, whereby the hot air absorbs an amount of moisture from the moist organic material in each zone. The air stream is reheated after it exits the material stream at one zone and before it enters the material stream at another zone further upstream.

An embodiment of the method may be used with a mat of forage crop, such as alfalfa, and the drying is performed using about 3–7 zones.

Advantages arising from using the method of the invention include a more efficient use of the heated air in drying the material. The condition of the air relative to its moisture level can be better monitored, and the drying efficiency and the condition of the finished product can be optimized.

These and various other advantages and features of novelty which characterize the invention are pointed out with particularity in the claims annexed hereto and forming a part hereof. However, for a better understanding of the invention, its advantages, and the objects obtained by its use, reference should be made to the accompanying drawings and descriptive matter which form a further part hereof, and in which there is illustrated and described a preferred embodiment of the invention.

BRIEF DESCRIPTION OF THE DRAWINGS

In the drawings wherein corresponding reference numerals generally indicate corresponding parts throughout the several views.

DETAILED DESCRIPTION OF PREFERRED EMBODIMENTS

Figure 1:
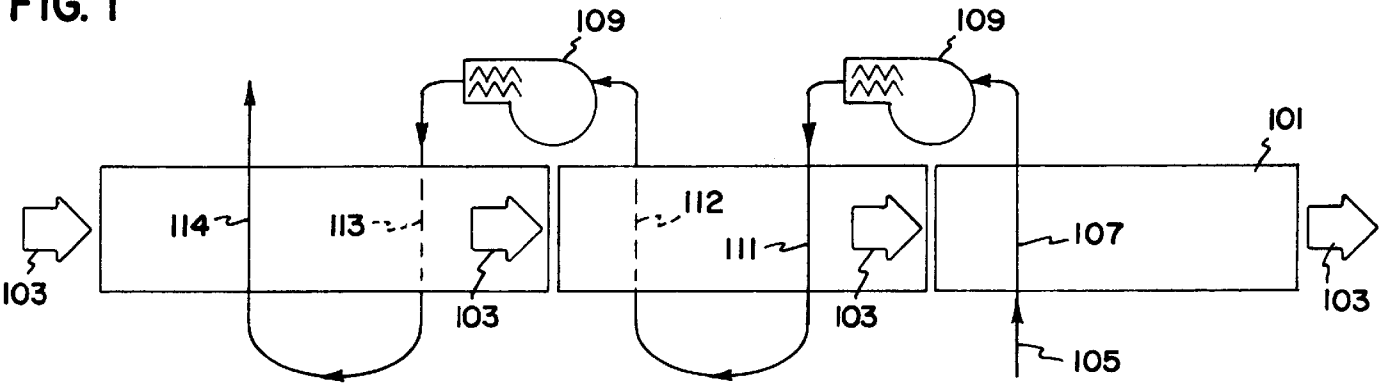
FIG. 1 is a schematic side view of an embodiment of the method according to the invention.

FIG. 1 schematically illustrates a side view of an embodiment of the method according to the invention. The present invention is a method of drying moist organic material. In one application of the invented method, the moist organic material is a forage crop, such as alfalfa or other similar plants. The initial moisture content of the organic material will depend on a number of factors, and may in one application be about 40–50%, but in other applications could be as low as 20% or as high as it is when freshly cut.

The moist organic material is fed in a flow 101. The material flows in the direction indicated by arrows 103. As noted above, the situation under which the organic material is inserted for drying may vary, i.e. it could come straight from harvest or it could be taken up from the field some time after it was cut. It is unlikely that the material is inserted for drying straight from cutting as the moisture level (measured in percent by weight of the total) is very high at this time and thus the drying cost and/or energy used for drying will also be very high. The material flow can be created, for example, by feeding the moist organic material along a conveyor belt system.

The flow 101 is preferably substantially continuous, such as an uninterrupted stream of organic material. For example, a mat of organic material which is being dried may be approximately 8 ft wide, 30 ft long and have a thickness from about 12 to 20 in. The size and configuration of the mat may be chosen in consideration of the capacity of the drying process being used, including the heaters, the desirable size and shape of the organic material after drying, whether the material will be baled etc. Typically, the organic material will have substantially the temperature of the surrounding air before it is treated by the drying process.

An air flow 105 is passed through the flow 101 a number of times. The air flow may be conveyed by a duct or tube system, which interacts with for example a conveyor belt system used for the organic material, to allow the air flow to pass through the flow of organic material. The air flow 105 is initially passed through the flow 101 at apart 107. The air flow 105 is typically taken "from the outside", that is from the ambient air surrounding the machine etc. performing the invented process. The humidity of the ambient air will of course vary depending on for example present weather conditions and climate. In this embodiment, the air is not preconditioned in any particular way prior to entering the flow 105, but it may be necessary to keep the air intake reasonably separate from any air outlets exhausting air with a high moisture content. In the shown embodiment the air flow 105 has not been heated prior to passing through the flow 101 at the part 107. In another embodiment the air flow 105 may be heated before it is passed through the flow 101.

In an exemplary process, the air flow 105 has a flow rate from about 15,000 to 30,000 cfm (cubic feet per minute), and a velocity from about 300 to 500 fpm (feet per minute).

When the air flow 105 passes through the flow 101 at the part 107, it absorbs an amount of moisture from the organic material. How much moisture is absorbed may depend on a number of factors, such as: the initial temperature of the air; the temperature of the material, the moisture content of the material, the rate of the air flow, the humidity of the ambient air. Similarly, the moisture content of the air flow after passing through the flow 101 may depend on the amount of absorbed moisture, initial humidity, etc.

When the air flow 105 passes through the flow 101 at the part 107, the material flow 101 typically has a relatively high temperature. In passing, the temperature of the air flow 105 will increase and the temperature of the material flow 101 will decrease. After exiting the flow 101 at the part 107 the air flow 105 is heated to a higher temperature. This may be done for example using a heater-blower 109. Simply put, a heater-blower 109 includes a blower which blows the air through a heater. Besides being heated, the air flow 105 is kept flowing at a substantially constant rate by the heater-blowers 109. The air flow will generally be heated to a temperature higher than its initial temperature. For example, the air flow 105 may be heated to a temperature ranging from about 250 to 350° F. in one embodiment.

The air flow 105 is passed through the flow 101 at a part 111, which is further upstream in the flow 101 than the part 107. The moisture content of the organic material is typically higher in upstream portions than in downstream portions. This is due to the higher number of times the organic material has had air flow passed through it when it reaches downstream parts. Accordingly, the organic material has a higher moisture content at part 111 than at part 107. Due to the higher air temperature, the reheated air flow entering part 111 has a higher capacity of absorbing moisture than had the air flow exiting part 107. The air flow 105 will again absorb moisture from the organic material and decrease its temperature in passing through part 111. As noted above, the amount of moisture absorbed and the resulting humidity of the air flow will depend on the circumstances under which the drying takes place.

After the air flow 105 exits the flow 101 at part 111, it is reversed and bypasses the flow at a part 112, further upstream from part 111. The air flow 105 is represented by a dashed line at part 112, to indicate that the air flow 105 bypasses the flow 101 without contact.

After bypassing the flow at part 112, the air flow 105 is reheated using heater-blower 109. The air flow may be reheated to a suitable temperature, generally higher than the temperature it was heated to previously. The reheated air flow 105 is reversed and bypasses the flow at a part 113, further upstream from part 112. The air flow 105 is represented by a dashed line at part 113, to indicate that the air flow 105 bypasses the flow 101 without contact.

After bypassing the flow at part 113, the air flow 105 is passed through the flow at a part 114, further upstream from part 111. In the illustrated embodiment, the air flow is exhausted "to the outside", i.e. to the ambient air, after exiting part 114 of the flow 101.

As illustrated in FIG. 1, the hot air of the air flow 105 is passed through the flow 101 two times—at parts 111 and 114. As will be further discussed below, the number of times the hot air passes through the flow is typically chosen such that the organic material will have a desired moisture content after the drying process.

Figure 2:
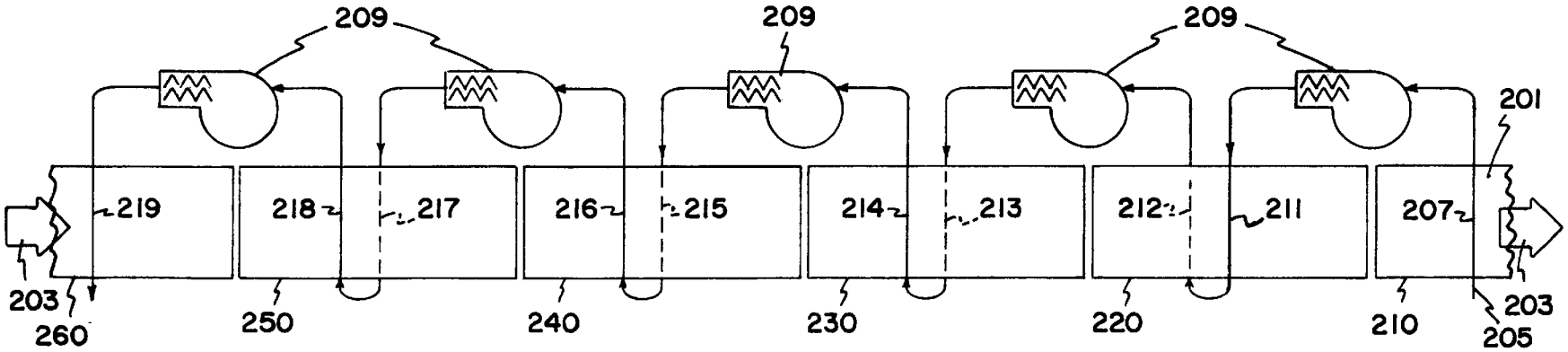
FIG. 2 is a schematic side view of another embodiment of the method according to the invention.

FIG. 2 schematically illustrates a side view of another embodiment of the method according to the invention. The method may be carried out using essentially similar equipment as in the method illustrated in FIG. 1, but some differences are that a greater number of heater-blowers are used and the air flow is passed through the flow of material a greater number of times.

The moist organic material is fed in a flow 201, in a direction indicated by the arrows 203. The undried material enters from the left side of flow 201 and the dried material exits the flow on the right side. A flow of air 205 is passed through the flow 201 in a number of zones. The zones are denoted by numbers 210, 220, 230, 240, 250 and 260 in FIG. 2.

The air is passed through the organic material at least once in every zone. This corresponds to the air passing through the material at the parts 207, 211, 214, 215, 218 and 219 of the flow 201. The air flow 205 also bypasses the organic material without being reheated at parts 212, 213, 216 and 217 of the flow 201. After passing through the organic material in the last zone, here zone 260, the air flow is exhausted into the ambient air.

When the air flow 205 passes through the material, it absorbs moisture and decreases its temperature substantially as described above. The air flow contains more moisture in higher-numbered zones, i.e. the air flow in zone 260 contains more moisture than the air flow in zone 230. The organic material will have higher moisture content in higher-numbered zones. In many embodiments, using about 3–7 zones will provide satisfactory results. Preferably, the material flow has a moisture content of about 15–30% after the drying. More preferably, the moisture content is about 15–25%. Most preferably, the material flow has a moisture content of about 15–20% after the drying.

As is seen in the illustrations, the air flow passes through the material flow in altering directions every time. For example, in part 211 the air flow goes "down", in part 214 it goes "up", in part 215 the air flow goes "down", in part 218 it goes "up" and in part 219 the air flow goes "down". It will be further discussed below that this way of passing the air flow through the material flow has significant advantages and is preferred.

Figure 3:
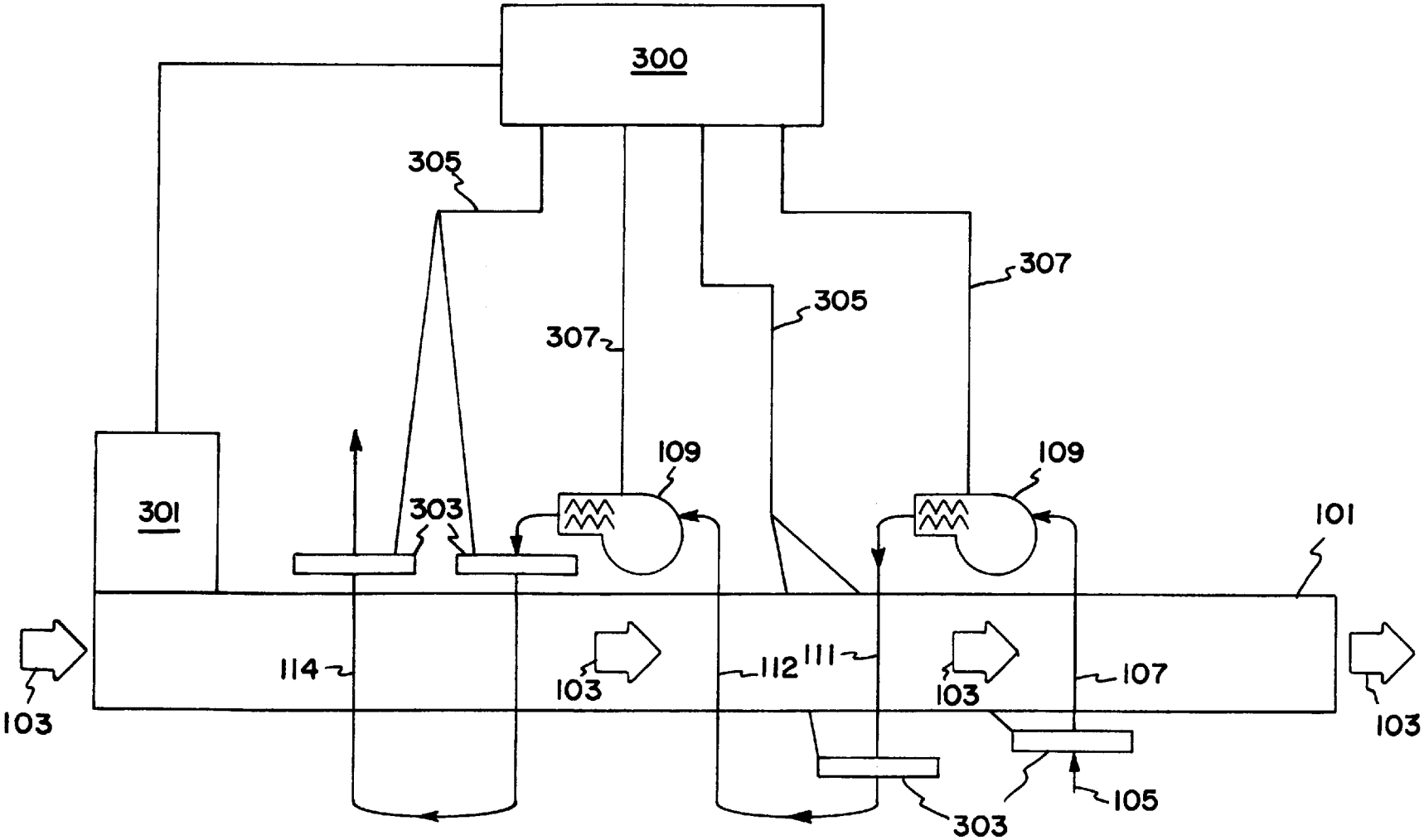
FIG. 3 is a schematic side view of the embodiment of FIG. 1 with controlling and monitoring means.

FIG. 3 shows the embodiment of FIG. 1 used with control and monitoring means. As noted above, the temperature and moisture content is of great relevance in using an embodiment of the method. This is one arrangement by which the method may be carried out, where the temperature and/or humidity at different positions of the air flow is monitored and used in optimizing the process parameters.

A general control unit 300 is shown schematically in FIG. 3. The control unit 300 includes logic and is capable of performing an algorithm suitable for the particular embodiment. The control unit may include a processor, memory and other circuitry for this purpose. The control unit is connected to the heater-blowers 109 by connectors 307 to regulate the air flow and the heater level of the heater-blowers 109. The control unit 300 is also connected to a motor device 301, which drives the flow of organic material during the process. As noted above, the material may for example be supplied using a conveyor-belt system. Well-known motor devices may be used with this embodiment The control unit 300 controls the flow rate of the organic material by controlling the motor device 301.

Sensor devices 303 are shown schematically at a number of positions throughout the air flow 105. The number of sensor devices to be used should be determined for each application, and similarly the exact location of the devices. The sensor devices 303 measure the temperature and/or humidity level of the air flow at the location of the sensor device. Well-known sensor devices can be used for this purpose. The sensor devices 303 are connected to the control unit 300 by connectors 305, for transmitting information on the measured characteristics of the air flow. Depending on whether the devices measure temperature, humidity or both, the connectors should be chosen suitably. For example, the connectors may convey information as digital or analog signals to the control unit 300.

The control unit 300 receives information on the characteristics of the air flow from the sensor devices 303. As noted above, this may be temperature and/or moisture content information. Based on this information and supplemental preprogrammed information stored in the control unit, the control unit regulates the heating of the air flow, the flow rate of the air, and the flow rate of the organic material to obtain optimal drying of the organic material. For example, by increasing the air heating and/or the air flow rate, more moisture is removed from the organic material during the drying process. By increasing the flow rate of the organic material, less moisture is removed from the material, etc. For example, if the operator considers the organic material to have an unacceptably high moisture content after the drying process, he or she may alter one or more of the controlled process parameters (air flow rate, air heating temperature, material flow rate). The supplemental preprogrammed information may for example be obtained through a calibration procedure where the relationship between the moisture content in the organic material and the air flow characteristics is determined.

Optionally, the control unit 300 may have an input function whereby the operator can input operating parameters such as the ambient air temperature and humidity, and the initial moisture content of the organic material. If one or more of the input values is higher or lower than a normal value, the control unit 300 may adjust one or more of the controlled process parameters to compensate for the particular operating parameters.

Figure 4:
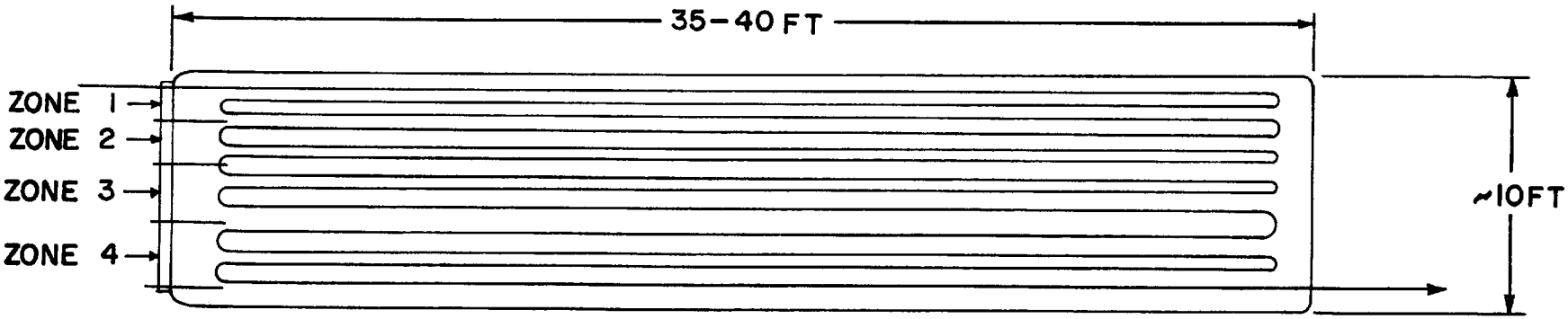
FIG. 4 is a schematic top view of an embodiment of the invention, where four zones are shown side-by-side.

In the illustrated embodiments the flow of organic material is shown as a straight flow through a number of zones. It should be noted that the zones may be situated in other configurations. For example, the zones may be situated side-by-side, as indicated schematically in FIG. 4. As illustrated, the material flow enters Zone 1 and passes through zones 2, 3 and 4 before it exits. In this illustration, the air flow is passed through the zones in vertical directions.

The number of times the hot air passes through the flow of organic material is typically chosen such that the organic material will have a desired moisture content after the drying process. The desired moisture content after drying will depend on the kind of material being dried, the intended use of the material, anticipated storage conditions etc. The air flow will typically be passed through the flow of organic material in the range of 3–7 times, but other numbers may be suitable for particular applications. The rate of air flow and the capacity of the heater-blowers will also affect the final moisture content of the material. The process of drying, from the time the moist organic material enters the flow until the time the dried organic material exits the flow, can be performed in less than 15 minutes. Preferably the drying process will take less than or about five minutes.

Figure 5:
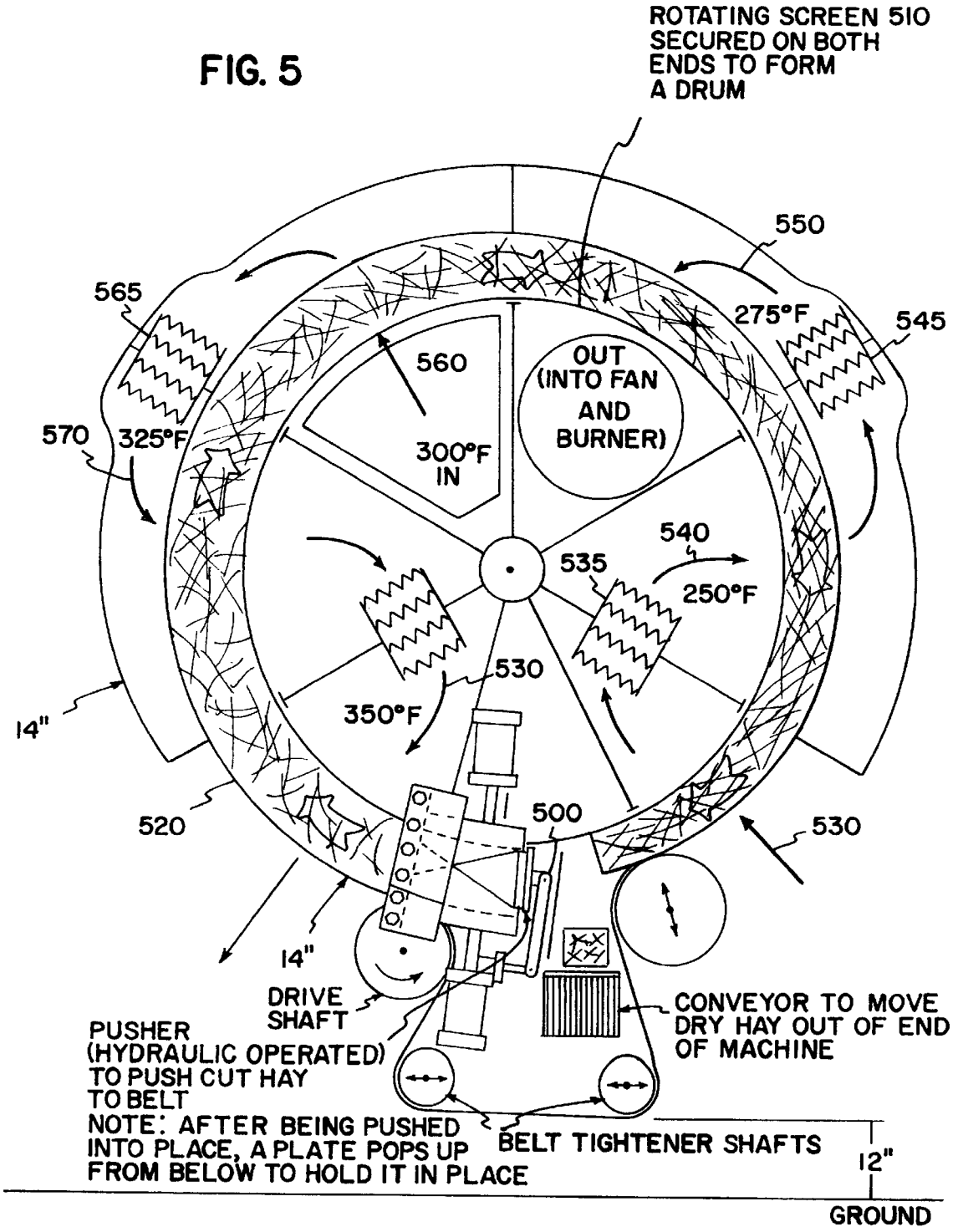
FIG. 5 is an embodiment of a rotating drum arrangement according to the invention.
Figure 6A:
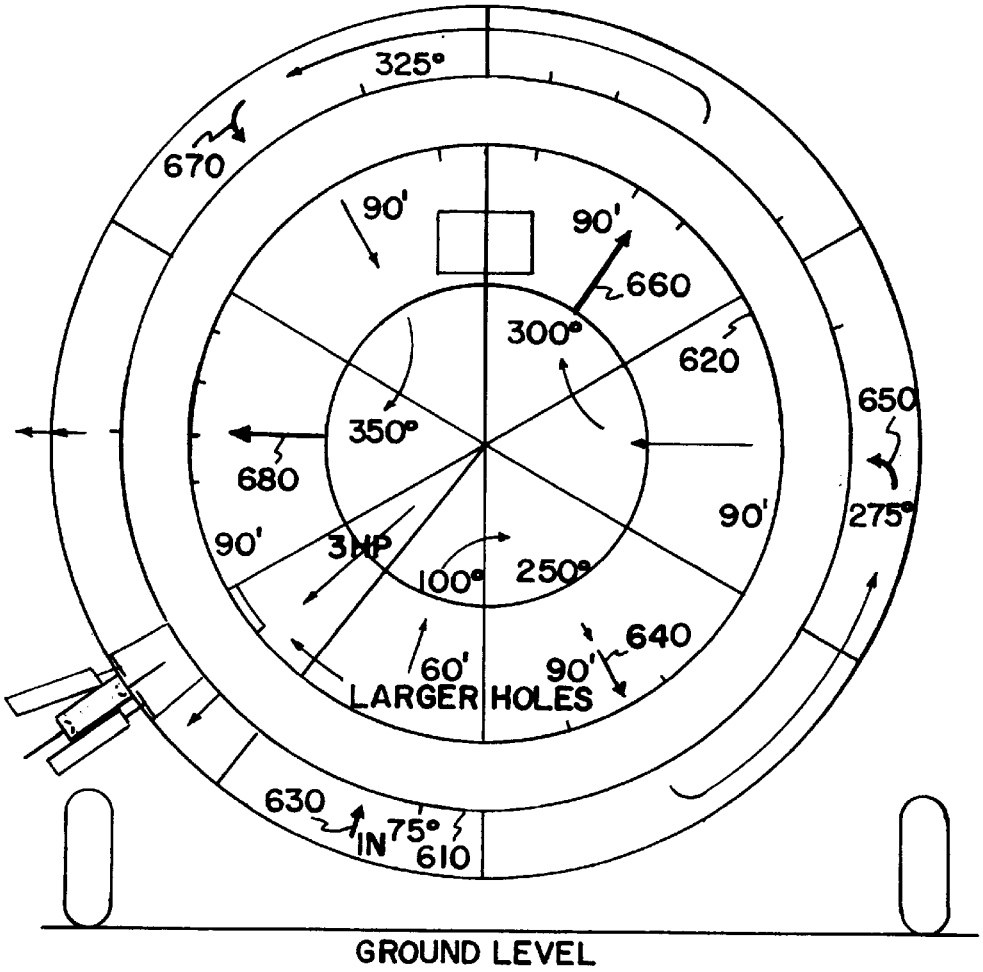
FIG. 6A is another embodiment of a rotating drum arrangement according to the invention.

In particular embodiments, the moist organic material is continuously supplied by using a rotating drum arrangement, where the organic material is situated at or near the periphery of a drum during the drying process. Two embodiments are shown in FIGS. 5 and 6A. The embodiments generally consist of a drum with heaters, fans and means for inserting the material. The drum is arranged horizontally, and FIGS. 5 and 6A show the drums in a front view. Material is inserted by means 500 at the bottom of the drum, along the entire length of the drum. The mat of material is circulated clockwise around the drum, as indicated by the white arrows. At the same time, an air flow is fed substantially counterclockwise through the drum as indicated by the black arrows, passing perpendicularly through the material in the different zones.

The material is confined between a rotating screen 510 and a belt 520. The rotating screen 510 is secured on both ends to form a drum. The belt 520 is tightened to conform to the particular thickness of the material mat that is inserted, and the belt 520 is driven by drive means. Moist organic material, such as hay, becomes more compact and occupies less volume as it is being dried. This is illustrated by the mat of material having less thickness at the end of the circle than at the beginning. The tightening of the belt 520 keeps the material mat in close contact with the drum all around the drum.

The embodiment will be further described by a description of its use for drying moist organic material. Ambient air is drawn into the drum as indicated by arrow 530, forming an air flow. In entering the drum, the air flow passes through the material flow which is just about to exit the drum after being dried. The material has a relatively high temperature at this point, and the air flow cools the material and absorbs some moisture.

The air flow is passed through a first heater 535 inside the drum. Some exemplary temperatures of the air flow are given at various places around the drum. The heated air flow passes through the material flow as indicated by arrow 540. This time the air flow goes out through the material, as opposed to in through the material at arrow 530.

The air flow is passed through a second heater 545 outside the drum. The heated air flow passes through the material flow as indicated by arrow 550. This time the air flow goes in through the material, as opposed to out through the material at arrow 540. Here, the air flow is drawn out of the drum through one of its side walls by a fan (not shown), gets heated by a heater (not shown), and reenters the drum in the next sector. The fan just mentioned is in fact used to propel the air flow throughout the drum. In the zones of the drum described so far, the fan creates the air flow by sucking the air. In the following zones, the fan blows the air through the drum to create an air flow. The heated air flow passes through the material flow as indicated by arrow 560. This time the air flow goes out through the material, as opposed to in through the material at arrow 550.

The air flow is passed through a fourth heater 565 outside the drum. The heated air flow passes through the material flow as indicated by arrow 570. This time the air flow goes in through the material, as opposed to out through the material at arrow 560. The air flow is passed through a fifth heater 575 inside the drum. The heated air flow passes through the material flow and out into the ambient air as indicated by arrow 580.

Figure 6B:
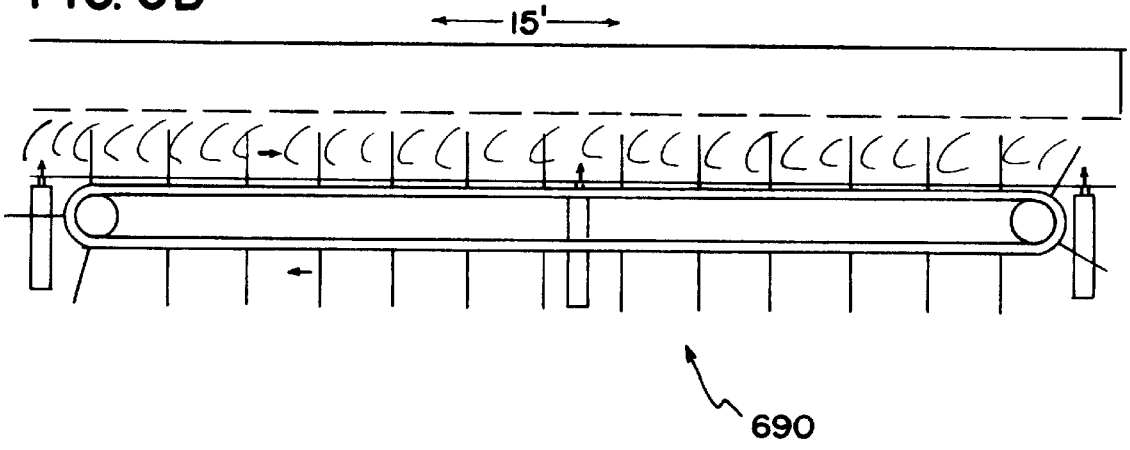
FIG. 6B is an embodiment of a cutting and feeding device.

FIG. 6A is another embodiment in accordance with the invention. It uses a fixed size drum assembly as opposed to the embodiment in FIG. 5, where the belt is tightened to fit the volume of the material. The drum assembly may for example consist of an outer drum 610 and an inner drum 620 inside the outer drum. A plurality of spacers are mounted radially between the outside of drum 620 and the inside of drum 610 to form compartments which may accommodate the material during drying. Material enters the drum assembly for example in the compartment 625, and the drum assembly is rotated clockwise. The air flow enters the drum assembly at the arrow 630 and passes through the material as indicated by arrows 640, 650, 660, 670 and 680 substantially as described above. The material may be fed into the drum assembly using for example a cutting and feeding device 690. The cutting and feeding device 690 comprises a conveyor belt arrangement with spikes perpendicular to the belt. The cutting and feeding device 690 as shown in FIG. 6B is mounted near the side of the drum assembly and the belt runs horizontally along the compartments of the assembly, whereby the spikes feed material into the compartment.

Some numerical examples will be given as further illustration of the process according to the invention. Below are two tables with results of a computer simulation of the drying process. The simulated process is substantially in accordance with the embodiment shown in FIG. 4, with the difference that six zones are used instead of four. The relative humidity of the ambient air was set at 60%, and the moisture content of the material is set to be 45% before the drying process. The material flow rate was set at 34419.7 lb/hr, and the air flow rate was set at 1222.26 lb/min. The material residence time was 1.93 min, and the material flow thickness was 12 inches. The belt width was set at 0.67 ft, and the belt speed was set at 264 ft/min.

TABLE 1

| Material Flow | | | | |
|---|---|---|---|---|
| | Temperature (F.) | | Moisture Content (% wet basis) | |
| Zone | Inlet | Outlet | Inlet | Outlet |
| 1 | 75.00 | 109.13 | 45.00 | 39.71 |
| 2 | 109.13 | 125.87 | 39.71 | 34.04 |
| 3 | 125.87 | 149.93 | 34.04 | 28.22 |
| 4 | 149.93 | 164.42 | 28.22 | 23.13 |
| 5 | 164.42 | 184.98 | 23.13 | 18.26 |
| 6 | 184.98 | 116.19 | 18.26 | 18.06 |

TABLE 2

| Air Flow | | | | | | |
|---|---|---|---|---|---|---|
| | Temperature (F.) | | Moisture Content (lb/lb dry air) | | Relative Humidity (%) | |
| Zone | Inlet | Outlet | Inlet | Outlet | Inlet | Outlet |
| 1 | 350.00 | 153.36 | 0.1303 | 0.1769 | 1.89 | 80.70 |
| 2 | 325.00 | 167.55 | 0.0902 | 0.1303 | 1.94 | 45.03 |
| 3 | 325.00 | 181.77 | 0.0567 | 0.0902 | 1.28 | 23.88 |
| 4 | 300.00 | 196.78 | 0.0321 | 0.0567 | 1.08 | 11.40 |
| 5 | 300.00 | 206.72 | 0.0119 | 0.0321 | 0.41 | 5.46 |
| 6 | 75.00 | 120.81 | 0.0111 | 0.0119 | 60.00 | 15.93 |

Table 1 shows characteristics of the material flow as it passes through zones 1–6. The material enters in zone 1 with a given temperature of 75° F. (ambient). When the air flow passes through the material, the temperature of the material increases to about 109° F. In table 2, the air flow characteristics are shown. The air flow enters in zone 6 with a given temperature of 75° F. (ambient) After passing through the material flow in zone 6, the air flow is heated before passing through the material as described previously.

In this exemplary simulation, the temperature of the material flow increases in zones 1–5 due to the heated air flow, and decreases in zone 6 due to the ambient air flow. The moisture content of the product stream is decreased from 45 to about 18% in the process.

The moisture content of the air flow increases when it is passed through the material flow. By reheating the air flow, the relative humidity is decreased between the times it passes through the material flow, allowing the air flow to absorb more moisture. The relative humidity of the air stream is about 80% when the air stream exits the process at zone 1.

Figure 7:
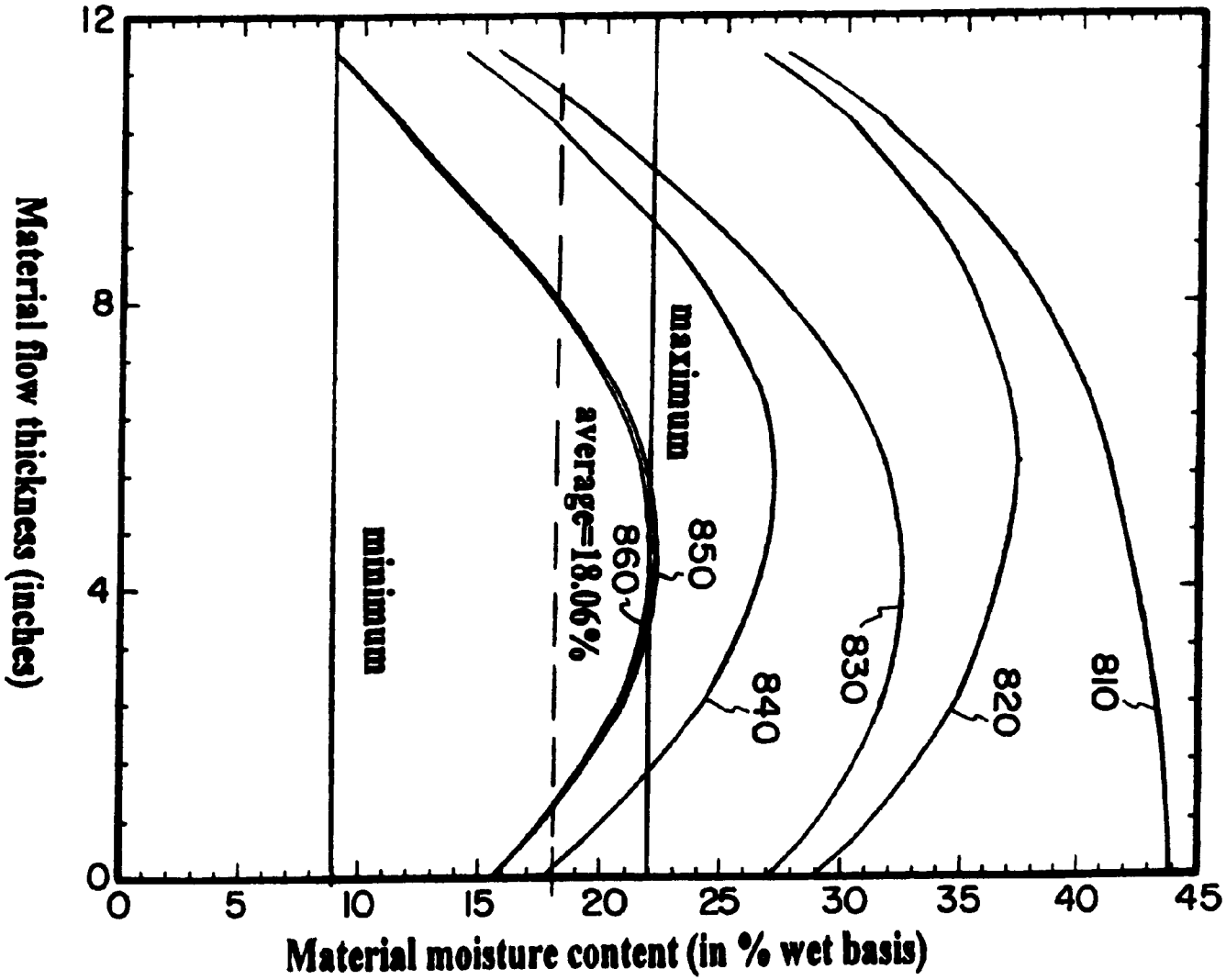
FIG. 7 is a graph showing the results of a computer simulation of an embodiment of the present invention.

In the tables, the moisture content of the product stream was given as a single value for every zone. However, it is expected that the moisture content will vary somewhat between for example the outer surfaces of the material flow and the center of the flow. FIG. 7 is a graph showing the amount of moisture in a computer simulation substantially in accordance with the embodiment shown in FIG. 2. The moisture content is shown over the thickness of the material flow in the various zones. The material thickness is shown on the horizontal axis; in this example the material flow is about 12 in. thick. The material moisture content (measured in % wet basis) is shown on the vertical axis. The material flow has an initial moisture content of about 45%.

The curve 810 shows the moisture content after the material has passed the first zone. The air flow enters horizontally from the left of the diagram and exits to the right after passing through 12 in. of material. It can be seen that the moisture content has decreased more on the incoming side of curve 810 than on the outgoing. This is because the air becomes more saturated with moisture as it passes through the material, and the more saturated it becomes, the less moisture it absorbs.

The curve 820 shows the moisture content after the material has passed the second zone. The air flow enters horizontally from the right of the diagram and exits to the left after passing through the material flow. It can be seen that the moisture content is decreased significantly from the previous zone at the surface facing the air flow (thickness= 0), and that there is less decrease at the other surface. The moisture content in the center of the material flow decreases, but remains higher than at the surfaces.

The curve 830 shows the moisture content after the material has passed the third zone. The air flow enters horizontally from the left of the diagram and exits to the right after passing through the material flow. As noted above, the moisture content is decreased significantly from the previous zone at the surface facing the air flow and there is less decrease at the other surface. The decrease in moisture content at the center of the material flow is somewhere between the decrease at the surfaces.

The curve 840 shows the moisture content after the material has passed the fourth zone, and similarly, curve 850 shows the moisture content after the material has passed the fifth zone. In the sixth zone, the air stream has ambient temperature, and the curve 860 shows only a marginal decrease in moisture content from curve 850. As noted above and illustrated in the tables, this zone is used primarily as a cooling step, to decrease the temperature of the material. The material flow has an average moisture content of about 18% after the sixth zone, but the moisture content is higher in the center of the material flow than at the surfaces. The graph shows that the moisture content of the material is confined between the maximum and minimum levels as indicated.

The simulation in FIG. 7 illustrates the advantages of passing the air flow through the material from alternating sides during the drying. Curve 810 gives an indication of how asymmetrically distributed across the thickness of the material the moisture would become if the air flow was passed through the material from the same side throughout the drying, which would make the process less effective. Furthermore, the material at the surface facing the air flow may likely be overheated, overdried and destroyed before the material at the other surface was dried to an acceptable level.

It should be clear from the description of the various embodiments above that a particular volume of air is not used to dry the same part of the organic material twice.

The efficiency of drying the organic material is significantly increased by reheating the used air before passing it through the material. At the increased temperature the reheated air can absorb moisture to an extent which is not possible at the previous temperature. Reheating the air two, three or more times in the drying process enables the operator to better monitor the condition of the air relative to its moisture level and to achieve optimum drying efficiency and final condition of the material to be dried. Furthermore, passing the air flow in alternating directions through the material flow gives uniform and efficient drying results.

It is to be understood that even though numerous characteristics and advantages of the present invention have been set forth in the foregoing description, together with details of the structure and function of the invention, the disclosure contained herein is illustrative, and changes in matters of order, shape, size and arrangement of parts and of steps may be made within the principles of the present invention and to the full extent indicated by the broad general meaning of the terms in which the appended claims are expressed.

What is claimed is:

1. A method for drying a moist organic material which is continuously supplied in a stream, the method comprising:

passing hot air through the moist organic material in a part of the stream to absorb an amount of moisture, whereby the moist organic material cools the hot air into warm air;

reheating the warm air after it exits the moist organic material to form reheated air with increased capability of absorbing moisture; and passing the reheated air through the moist organic material further upstream, which has a greater moisture content.

2. The method of claim 1, further comprising the step of providing the moist organic material in form of a mat, which is continuously fed forward.

3. The method of claim 2, further comprising the step of dividing the mat into a plurality of pieces when the moist organic material has been dried, the pieces being of a shape suitable for baling.

4. The method of claim 2, wherein the moist organic material is provided in form of a mat having a thickness of about 12 to 20 in.

5. The method of claim 2, wherein the moist organic material is provided in form of a mat having a width of about 5 to 10 ft.

6. The method of claim 1, wherein the moist organic material comprises forage crop.

7. The method of claim 6, wherein the forage crop has a moisture content of about 40 to 55% before the hot air is passed through it.

8. The method of claim 1, wherein the steps of reheating the warm air and passing the reheated air through the moist organic material further upstream are repeated until the warm air has a moisture content approaching 100%.

9. The method of claim 1, wherein the steps of reheating the warm air and passing the reheated air through the moist organic material further upstream are repeated about 3 to 7 times.

10. The method of claim 1, wherein reheating the warm air comprises reheating the warm air to a temperature substantially equal to or higher than an initial temperature of the hot air.

11. The method of claim 1, wherein the warm air is reheated to a temperature of about 250 to 360° F.

12. The method of claim 6, wherein the forage crop has a moisture content of 15% to 30% upon completion of the drying process.

13. The method of claim 12, wherein the drying process takes less than 5 minutes.

14. The method of claim 1, wherein the moist organic material is continuously supplied by a rotating drum arrangement.

15. The method of claim 1, wherein the hot air is passed through the moist organic material in one direction, and the reheated air is passed through the moist organic material in an opposite direction.

16. The method of claim 1, wherein the moist organic material is of uniform thickness throughout the stream.

17. A method for drying moist organic material using hot air, the method comprising:

providing the moist organic material in a continuous material stream;

providing the hot air in a continuous air stream, where the air stream flows in a direction generally opposite to that of the material stream;

passing the air stream perpendicularly through the material stream at a plurality of zones, whereby the hot air absorbs an amount of moisture from the moist organic material in each zone; and reheating the air stream after it exits the material stream at one zone and before it enters the material stream at another zone further upstream.

18. The method of claim 17, wherein the moist organic material comprises forage crop.

19. The method of claim 17, further comprising the step of ceasing to pass the air stream through the material stream when the air stream has a moisture content approaching 100%.

20. The method of claim 17, wherein the air stream is passed through the material stream at about 3 to 7 zones.

21. The method of claim 17, further comprising passing the air stream through the material stream from alternating directions in every subsequent zone.

22. The method of claim 17, wherein the material stream has uniform thickness.

23. The method of claim 17, further comprising passing ambient air through a last zone of the material stream, and using the ambient air to provide the hot air in the continuous air stream.

* * * * *